US005258062A

United States Patent [19]

Nakazawa et al.

[11] Patent Number: 5,258,062

[45] Date of Patent: Nov. 2, 1993

[54] ELECTROLESS GOLD PLATING SOLUTIONS

[75] Inventors: Masao Nakazawa, Nagano; Masaaki Yoshitani, Ueda; Shinichi Wakabayashi, Nagano, all of Japan

[73] Assignee: Shinko Electric Industries Co., Ltd., Nagano, Japan

[21] Appl. No.: 531,151

[22] Filed: May 31, 1990

[30] Foreign Application Priority Data

| | | | |
|---|---|---|---|
| Jun. 1, 1989 | [JP] | Japan | 1-139900 |
| Dec. 21, 1989 | [JP] | Japan | 1-332162 |
| Mar. 19, 1990 | [JP] | Japan | 2-68902 |

[51] Int. Cl.[5] ..... C23C 18/42

[52] U.S. Cl. ..... 106/1.23; 106/1.26

[58] Field of Search ..... 106/1.23, 1.26

[56] References Cited

U.S. PATENT DOCUMENTS

| | | | |
|---|---|---|---|
| 3,123,484 | 3/1964 | Pokras et al. | 106/1.26 |
| 4,374,876 | 2/1983 | El-Shazly et al. | 106/1.26 |
| 4,804,559 | 2/1989 | Ushio et al. | 106/1.26 |
| 4,880,464 | 11/1989 | Ushio et al. | 106/1.26 |
| 4,919,720 | 4/1990 | Stavitsky | 106/1.26 |
| 5,130,168 | 7/1992 | Mathe et al. | 106/1.26 |

*Primary Examiner*—Helene Klemanski

*Attorney, Agent, or Firm*—Staas & Halsey

[57] ABSTRACT

An electroless gold plating solution comprises a base solution containing an alkaline hydroxide, water-soluble gold salt, boron hydrides, amino branes, and alkali metal cyanate, and further contains at least one of chemicals that of a fatty unsaturated alcohol, fatty unsaturated polyhydric alcohol, fatty unsaturated carboxylic acid, and derivatives thereof.

22 Claims, No Drawings

ELECTROLESS GOLD PLATING SOLUTIONS

BACKGROUND OF THE INVENTION

1. Field of the Invention

The present invention relates to an electroless gold plating solution, and more particularly, to an electroless gold plating solutions which will not damage ceramics and has a high deposition rate with high stability.

2. Description of the Related Art

Electroless plating is a very important means of plating a portion to which an electrical conduction cannot be obtained. The electroless solutions actually used for this process must be stable during use.

Although many various electroless plating solutions are in actual use, a usable electroless gold plating solution has not heretofore been developed. This is due to the very low stability of such electroless gold plating solutions.

The generally used electroless gold plating solutions contain alkaline hydroxide, alkali metal cyanide, boron hydrides, amino boranes and a water-soluble gold salt additive which acts as a metal supply source. However, such electroless gold plating solutions will be decomposed even if a small amount of nickel (few ppm) is dissolved in that solution.

For example, a ceramic package for a semiconductor device, is produced by forming a metallized conductor pattern on a ceramic substrate, forming a nickel electro- or electroless plating coating on the metallized conductor layer, and forming a gold plating coating on the nickel coating.

If the gold plating coating is formed by the above-mentioned electroless gold plating process, the nickel of the underlayer (substrate) will be dissolved in the solution and the solution is decomposed. Thus, the nickel substrate is first coated with a thin layer of immersion deposited gold before it is placed in real electroless (auto catalytic) gold plating solution. But the gold plating coating obtained by the immersion is extremely thin and porous so that the nickel of the under layer is dissolved during the electroless gold plating process. This dissolved nickel leads to less selective plating of gold and gold is deposited on the ceramic and finally excess nickel leads to spontaneous decomposition of the solution.

Due to the above problems associated with known solutions, it has been almost impossible to carry out an electroless gold plating of the nickel underlayer. In the case of the above-mentioned ceramic package, an electroplating process will be done after isolated patterns are all short-circuited. In this case, the connected conductor pattern must be removed after the gold plating.

Another problem is high alkalinity of commercially available electroless gold plating solutions. Such a strong alkaline gold plating solution corrodes ceramics, whereby the surface of the ceramic substrate is coarsened. This surface roughness lowers the quality of products. Further, since the silica, etc., of the ceramic components is dissolved in the plating solution, the life of the expensive gold plating solution is shortened.

To obtain an electroless gold plating solution which does not corrode ceramics, the pH of the plating solution must be lowered to less than 13, but when the pH of the gold plating solution is lowered to such a level, the gold deposition rate is lowered to 0.2 μm/hour or less.

SUMMARY OF THE INVENTION

Therefore, an object of the present invention is to provide electroless gold plating solutions that can plate gold stably with good appearance, adhesion and selectivity on nickel and metal conductors.

Another object of the present invention is to provide an electroless gold plating solution which does not corrode ceramics and has a high deposition rate.

Accordingly, there is provided an electroless gold plating solution comprising a base solution containing alkaline hydroxide, water-soluble gold salt, boron hydrides or amino boranes, and alkali metal cyanide, and further containing an amount of a monoamino monocarboxylic acid and/or alkali chloride necessary to adjust the pH of the electroless gold plating solution between 10 and 12. According to the present invention, the base solution further preferably contains a surfactant or surfactants, such as sodium alkylbenzene-sulfate, sodium alkylnaphthalenesulfate, lauryltrimethylammonium-chloride, and sodium dodecyletherphosphate. Further, according to the present invention, a thallium compound or a lead compound may be contained in the base solution as a grain refiner.

The alkali metal cyanide usually acts as a solution stabilizer, and in the present invention, the added monoamino monocarboxylic acid such as glycine alanine, etc., and/or alkali chloride acts as a pH stabilizer. Therefore, amount of the alkali cyanide to be added is smaller than that of the usual electroless gold plating solution, 0.01 g/l to 1 g/l.

The amount of glycine and the alkali chloride to be added is related to the composition of the base solution, and is an amount sufficient to adjust the bath's pH to between 10 and 12.

The glycine and the alkali chloride may be added independently to lower the bath's pH, but even in each case, the corrosion of ceramic package is nothing. Further, a gold deposition rate of about 2 μm/hour can be obtained, which is higher than the about 1.5 μm/hour obtained by a conventional strong alkaline solution.

Namely, the use of glycine and/or alkali chloride improves the buffering capacity of the solution and provides a stabilized low pH value, and thus the plating solution does not corrode ceramics.

Further, according to the present invention, there is provided an electroless gold plating solution comprising a base solution containing an alkaline hydroxide, water-soluble gold salt, boron hydrides or amino boranes, and alkali metal cyanide, and also containing at least one of sulfonic acid derivatives or their salts thereof, and sulfonamide derivatives and sulfonimide derivatives or salts thereof as a stabilizer.

In the present invention, by adding sulfonic acid derivatives or salts thereof, and sulfonamide derivatives, and sulfonimide derivatives or their salts thereof, which act as stabilizer, the plating solution can be stabilized and decomposition of the solution can be prevented. The above-mentioned stabilizer may be used above or as a combination thereof.

The term "stabilization" refers to the state that the bath does not decompose by small amounts of dissolved nickel, and can plate stably for a long time.

Preferably, the amount of the stabilizer to be added is 0.01 g/l or more.

The upper limit of the amount to be added is not particularly critical, but is about 50 g/l from the economical viewpoint.

According to the present invention, as the sulfonic acid derivatives or salts thereof, at least one of aminobenzenesulfonic acid, 1,5-naphthalene disulfonic acid, 1,3,6-naphthalenetrisulfonic acid or those alkali metal salts are preferably used.

With respect to the sulfonamide derivatives, at least one of aminosulfonamide or toluensulfonamide is preferably used.

Further, with respect to the sulfonimide derivatives or salts thereof, o-sulfonbenzimide or its alkali metal salts thereof are preferably used.

According to the present invention, the lead compounds or thallium compounds usually added to an electroless gold plating solution may be further added to the base solution. Preferably, the amount of lead compounds or thallium compounds is 0.1 to 50 ppm (as a metal conversion value).

According to the present invention, preferably 0.0001 to 10 ml/l of a surfactant(s) such as polyoxyethylenealkylphenylether or polyoxyethylenealkylether is added to the base solution, to dissipate bubbles and thus obtain an improved gold plating film. The above-mentioned range of the surfactant is defined as such because the appearance of the gold plating is kept good. Preferably 0.01 to 50 g/l of sulfur compounds in a mercapto group type, such as thiourea and thiomalic acid, etc., is added to the base solution. The sulfur compounds act as a stabilizer for the boron compounds, which act as a reducing agent. The range of the sulfur compounds is defined as such because the decomposition rate of the reducer is kept well.

The pH of the electroless gold plating solution is controlled to within 10 to 14, by adding a pH-controlling salt.

According to the present invention, there is still further provided an electroless gold plating solution comprising a base solution containing an alkaline hydroxide, water-soluble gold salt, boron hydrides, amino boranes, and alkali metal cyanide, and further containing at least one of the chemicals selected from the group of fatty unsaturated alcohol, fatty unsaturated polyhydric alcohol, and fatty unsaturated carboxylic acid, and derivatives thereof, as a stabilizer.

The fatty unsaturated alcohol, the fatty unsaturated polyhydric alcohol, and the fatty unsaturated carboxylic acid and derivatives thereof, stabilize the solution and prevent a bath decomposition of thereof.

Preferably, the amount of the stabilizers such as the fatty unsaturated alcohol, etc., to be added is 0.1 g/l or more. The upper limit of the amount to be added is not particularly critical, but is about 50 g/l from the economical viewpoint.

According to the present invention, as the fatty unsaturated alcohol or derivatives thereof, allyl alcohol, crotyl alcohol, propargyl alcohol, 2-butyne-1-ol, 3-butyne-1-ol or esters thereof, etc., are preferably used.

Further, as the fatty unsaturated polyhydric alcohol or derivatives thereof, 2-butyne-1,4-diol, 1-butyne-3,4-diol, 2-pentyne-1,5-diol, 2-pentyne-1,4-diol or esters thereof, etc., are preferably used.

Furthermore, as the fatty unsaturated carboxylic acid or derivatives thereof, propiolic acid, acetylenedicarboxylic acid and ethyl propiolate, ethyl acetylenedicarboxylate, etc., are preferably used.

According to the present invention the electroless gold plating solution further preferably contains at least one of sulfonic acid derivatives or salt thereof, sulfonamide derivatives, and sulfonimide derivatives or salts thereof. Namely, the sulfonic acid derivatives, etc., can be used above or in a combination thereof. By adding the sulfonic acid derivatives, etc., the solution is stabilized and the bath decomposition can be avoided. Preferably, the amount of the sulfonic acid derivatives, etc., to be added is 0.01 g/l or more. The upper limit of the amount to be added is not particularly critical, but is about 50 g/l from the economical viewpoint.

According to the present invention, as the sulfonic acid derivatives or salts thereof, at least one of a chemical selected from the group of aminobenzenesulfonic acid, 1,5-naphthalenedisulfonic acid, 1,3,6-naphthalenetrisulfonic acid or alkali metal salts thereof, etc., is preferably used.

Further, as the sulfonamide derivatives at least one of the chemicals aminosulfonamide or toluensulfonamide is preferably used.

Further, as the sulfonimide derivatives or salts thereof, o-sulfobenzimide or alkali metal salts thereof, etc., are preferably used.

Further, in the present invention, preferably the monoaminomonocarboxylic acid such as glycine, alanine, valine, etc., and/or alkali chloride is also added to the electroless gold plating solution.

Further, in the electroless gold plating solution of the present invention, lead compounds or thallium compounds may be added as a crystal refining agent, as explained above.

Furthermore, a surfactant such as polyoxyethylenealkylphenylether, and polyoxyethylene alkylether, etc., may be added to the base solution in an amount of 0.0001 to 10 ml/l, whereby bubble dissipation is prevented and the obtained gold plating film is improved.

Further, preferably 0.01 to 50 g/l of a sulfur compound in a mercapto group type, such as thiourea and thiomalic acid, etc., is added to the base solution. The sulfur compounds act as a stabilizer for the boron compounds.

DESCRIPTION OF THE PREFERRED EMBODIMENTS

First, examples in which glycine and/or alkali chloride are added to a base solution containing alkaline hydroxide, alkali metal cyanide water-soluble gold salt and boron hydrides or amino boranes, are described.

The base electroless gold plating solution formulation is as follows:

| Base Solution 1 | |
|---|---|
| KOH | 45 g/l |
| KCN | 1.3 g/l |
| $KAu(CN)_2$ | 5.8 g/l |
| Dimethylamine borane | 24.0 g/l |
| Pb | 1.5 ppm |

The pH of the base plating solution was 13.6. When an alumina ceramic package was immersed in the Base Solution 1 for 10 minutes, the concentration of Si dissolved from the ceramic package was about 6 ppm.

EXAMPLE 1

First, 15 g/l of glycine and 12 g/l potassium chloride were added to the Base Solution 1, and thus the pH of the obtained solution became 11.0. When alumina ceramic package was immersed in the electroless gold plating solution having a pH of 11.0 for 2 hours, the concentration of Si in the solution was the same as that before the immersion. Further, by using this solution, an electroless gold plating was carried out on an electroless nickel plated- and a immersion gold plated ceramic package, and a gold deposition rate was 1.9 μm/hour (the deposition rate was calculated with the weight difference after and before plating). The obtained value of 1.9 μm/hour was substantially the same value as that before the addition of the glycine and the potassium chloride.

EXAMPLE 2

First, 15 g/l of glycine alone was added to the Base Solution 1, and thus the pH of the obtained solution became 11.3. Then a ceramic package was immersed in the solution for 2 hours, but Si was not dissolved from the ceramic package, and the obtained gold deposition rate in an electroless gold plating was 1.8 μm/hour.

EXAMPLE 3

First, 30 g/l of only potassium chloride was added to the Base Solution 1, and thus the pH of the obtained solution became 11.9. Then a ceramic package was immersed into the solution for 2 hours, but Si was not dissolved from the ceramic package, and the obtained gold deposition rate in an electroless gold plating was 1.9 μm/hour.

EXAMPLE 4

Thallium compounds were substituted for lead compounds in (the Examples 1 to 3), and substantially the same results as described in the above-mentioned examples were obtained.

EXAMPLE 5

A surfactant such as sodium alkylbenzenesulfate, sodium alkylnaphthalenesulfate, lauryltrimethylammoniumchloride, sodium dodecyletherphosphate, etc. was further added to the example Solution 1, and substantially the same results as described in the above-mentioned examples were obtained.

Examples in which, at least one of several group of sulfonic acid derivatives or their salts, sulfonamide derivatives, sulfonimide derivatives or their salts are added as a stabilizer, to a base solution containing alkaline hydroxide, alkali metal cyanide, water-soluble gold salt, boron hydride or amino boranes, are now described.

The base electroless gold plating solution formulations are as follows:

| | |
|---|---|
| Base Solution 2 | |
| KOH | 11.2 g/l |
| KCN | 13.0 g/l |
| $KAu(CN)_2$ | 5.8 g/l |
| $KBH_4$ | 21.6 g/l |
| Base Solution 3 | |
| KOH | 45.0 g/l |
| KCN | 1.3 g/l |
| $KAu(CN)_2$ | 5.8 g/l |
| Dimethylamine borane | 23.6 g/l |

EXAMPLE 6

An electroless gold plating solution was prepared by adding 10.0 g/l of sodium 1,3,6-naphthalenetrisulfonate to the Base Solution 2, and using this solution, an electroless gold plating was carried out on a immersion gold-plated nickel substrate of a ceramic package for a semiconductor device for 1 hour, under conditions of a mild agitation and a temperature of 85° C. A 1.5 μm thick gold plated coating having a lemon yellow color and semi-bright was formed. Deposition of the gold on a ceramic substrate and decomposition of the solution did not occur.

Further, the wire-bonding reliability, the die-bonding reliability, and the heat-resisting properties such as discoloration of the electroless gold plated coating of a ceramic package were all good.

An aminobenzenesulfonic acid or a sodium 1,5-naphthalenedisulfonate was added to the Base Solution 2 in place of sodium 1,3,6-napthalenetrisulfonate, and thus an electroless gold plating solution was prepared. When this solution was used, the same good results as described above were obtained.

An electroless gold plating using only the Base Solution 2 and the same conditions as described above was carried out, but gold was deposited on a ceramic substrate after 10 minutes and a decomposition of the solution occurred.

EXAMPLE 7

An electroless gold plating solution was prepared by adding 10.0 g/l of p-aminosulfonamide to the Base Solution 3, and using this solution, an electroless gold plating was carried out on a immersion gold-plated nickel substrate of a ceramic package for a semiconductor device for 1 hour under conditions of a mild agitation and a temperature of 85° C. A 1.7 μm thick gold plated coating having a lemon yellow color and bright was formed. A deposition of gold on a ceramic substrate and decomposition of the solution did not occur.

Further, the wire-bonding reliability, the die-bonding reliability, and the heat-resisting properties such as discoloration of the electroless gold plated coating of a ceramic package were all good.

p-toluenesulfonamide was added to the Base Solution 3 in place of p-aminosulfonamide, and thus an electroless gold plating solution was prepared. When this solution was used, the same good results as described above were obtained.

An electroless gold plating using only the Base Solution 3 and the same conditions as described above was carried out. Gold was deposited on a ceramic substrate after 7 minutes and decomposition of the solution occurred.

EXAMPLE 8

An electroless gold plating solution was prepared by adding 10.0 g/l of o-sulfobenzimide to the Base Solution 2, and using this solution, an electroless gold plating was carried out on an immersion gold-plated nickel substrate of a ceramic package for a semiconductor device for 1 hour, under conditions of a mild agitation and a temperature of 85° C. A 1.7 μm thick gold plated coating having a lemon yellow color and semi-bright was formed. A deposition of gold on a ceramic substrate and decomposition of the solution did not occur.

Further, the wire-bonding reliability, the die-bonding reliability, and the heat-resisting properties such as discoloration of the electroless gold plated coating of a ceramic package were all good.

An o-sulfobenzimide, sodium salt was added to the Base Solution 2 in place of the o-sulfobenzimide, and thus an electroless gold plating solution was prepared. When this solution was used, the same good results as described above were obtained.

EXAMPLE 9

A surfactant such as polyoxyethylenealkylphenyl ether, and polyoxyethylenealkyl ether, etc., was added to each solution of examples 6 to 8, and an electroless gold plating was carried out. During the plating process, a gold deposition on a ceramic substrate under the nickel layer and the bubble dissipation were good. Decomposition of the solution did not occur, and a good gold plating coating was obtained. The gold plating coating has a good wire bonding reliability, die bonding reliability, and heat-resisting property.

EXAMPLE 10

When 1 g/l of a thiourea, which is a mercapto compound, was added to the solutions of examples 6 to 9, a decomposition of boron hydrides, or amino boranes, could be avoided and thus the stability of the solution was increased.

Substantially the same good results were obtained by using thiomalic acid in place of the thiourea.

Furthermore, even when an optional mixture of the stabilizer of examples 6 to 8 was used, an improved electroless gold plating coating was obtained.

Examples in which at least one of the groups of a fatty unsaturated alcohol, a fatty unsaturated polyhydric alcohol, a fatty unsaturated carboxylic acid or their compound derivatives is added to the above-mentioned base solution as a stabilizer will now be described.

The base electroless gold plating solution formulations are as follows:

| | |
|---|---|
| Base Solution 4 | |
| KOH | 45 g/l |
| KCN | 1.3 g/l |
| $KAu(CN)_2$ | 5.8 g/l |
| Dimethylamine borane | 23.6 g/l |
| Base Solution 5 | |
| KOH | 11.2 g/l |
| KCN | 13.0 g/l |
| $KAu(CN)_2$ | 5.8 g/l |
| $KBH_4$ | 21.6 g/l |

EXAMPLE 11

An electroless gold plating solution was prepared by adding 5 g/l of propargyl alcohol to the Base Solution 5, and using this solution, an electroless gold plating was carried out on an immersion gold-plated nickel substrate of a ceramic package for a semiconductor device for 1 hour, under conditions of a mild agitation and a temperature of 85° C. A 1.7 μm thick gold plated coating having a lemon yellow color and semi-bright was formed. A deposition of gold on a ceramic substrate and decomposition of the solution did not occur.

Further, the wire-bonding reliability, the die-bonding reliability, and the heat-resisting properties such as discoloration of the electroless gold plated coating of a ceramic package were all good.

An allyl alcohol, a crotyl alcohol, 2-butyne-1-ol, and 3-butyne-1-ol were added to the Base Solution 5 in place of propargyl alcohol, and thus an electroless gold plating solution was prepared. When this solution was used, the same good results as described above were obtained.

EXAMPLE 12

An electroless gold plating solution was prepared by adding 10.0 g/l of a 2-pentyn-1,5-diol to the Base Solution 5, and using this solution, an electroless gold plating was carried out on an immersion gold-plated nickel substrate of a ceramic package for a semiconductor device for 1 hour, under conditions of a mild agitation and a temperature of 85° C. A 1.5 μm thick gold plated coating having a lemon yellow color and semi-bright was formed. A deposition of gold on a ceramic substrate and decomposition of the solution did not occur.

Further, the wire-bonding reliability, the die-bonding reliability, and the heat-resisting properties such as discoloration of the electroless gold plated coating of a ceramic package were all good.

2-butyne-1,4-diol, 1-butyne-3,4-diol and 2-pentyn-1,4-diol were added to the Base Solution 5 in place of the 2-pentyne-1,5-diol, and thus an electroless gold plating solution was prepared. When this solution was used, the same good results as described above were obtained.

EXAMPLE 13

An electroless gold plating solution was prepared by adding 10.0 g/l of a propiolic acid to the Base Solution 5, and using this solution, an electroless gold plating was carried out on an immersion gold-plated nickel substrate of a ceramic package for a semiconductor device for 1 hour, under conditions of a mild agitation and a temperature of 85° C. A 1.5 μm thick gold plated coating having a lemon yellow color and semi-bright was formed. A deposition of gold on a ceramic substrate and decomposition of the solution did not occur.

Further, the wire-bonding reliability, the die-bonding reliability, and the heat-resisting properties such as discoloration of the electroless gold plated coating of a ceramic package were all good.

Acetylenedicarboxylic acid, ethyl propiolate or ethyl acetylenedicarboxylate were added to the Base Solution 5 in place of the propiolic acid, and thus an electroless gold plating solution was prepared. When this solution was used, the same good results as described above were obtained.

EXAMPLE 14

A surfactant such as polyoxyethylenealkylphenyl ether, polyoxyethylenealkyl ether, etc., was further added to the solutions of examples 11 to 13, and an electroless gold platings then carried out under the same conditions as mentioned above. In this plating process the bubble dissipation property was good, and the deposition of gold on a ceramic substrate and decomposition of the solution did not occur, whereby an improved gold plating coating was obtained. The gold plating coating has an improved wire-bonding reliability, die-bonding reliability, and heat resisting property.

EXAMPLE 15

When 1 g/l of a thiourea, which is a mercapto compound was added to the solutions of examples 11 to 14, a decomposition of boron hydrides or amino branes could be avoided, and thus the stability of the solution was increased.

Substantially the same good results were obtained by using thiomalic acid in place of the thiourea.

Furthermore, even when an optional mixture of the stabilizer of examples 11 to 13 was used, an improved electroless gold plating coating was obtained.

EXAMPLE 16

An electroless gold plating solution was prepared by adding 5.0 g/l of a propargyl alcohol and 10.0 g/l of sodium 1,3,6-naphthalenetrisulfonate to the Base Solution 4. Using this solution, an electroless gold plating was carried out on an immersion gold-plated nickel substrate of a ceramic package for a semiconductor device for 1 hour, under conditions of a mild agitation and a temperature of 85° C. This plating was carried out 10 times. A deposition of gold on a ceramic substrate and decomposition of the solution did not occur.

Further, the wire-bonding reliability, the die-bonding reliability, and the heat-resisting properties such as discoloration of the electroless gold plated coating of a ceramic package were all good.

An aminobenzenesulfonic acid, 1,5-naphthalenedisulfonic acid or alkali metal salts thereof was added to the Base Solution 4 in place of sodium 1,3,6-naphthalenetrisulfonate, and the same good results were obtained as explained above.

EXAMPLE 17

An electroless gold plating solution was prepared by adding 10.0 g/l of an allyl alcohol and 10.0 g/l of o-sulfobenzimide to the Base Solution 2. Using this solution, an electroless gold plating was carried out on immersion gold-plated nickel substrate of a ceramic package for a semiconductor device for 1 hour under a condition of mild agitation and a temperature of 85° C. This plating was carried out 10 times. A deposition of gold on a ceramic substrate and decomposition of the solution did not occur.

EXAMPLE 18

An electroless gold plating solution was prepared by adding 10.0 g/l of a 2-pentyn-1,5-diol and 10.0 g/l of a p-toluenesulfonamide to the Base Solution 4. Using this solution, an electroless gold plating was carried out on an immersion gold-plated nickel substrate of a ceramic package for a semiconductor device for 1 hour under a condition of mild agitation and a temperature of 85° C. This plating was carried out 10 times. A deposition of gold on a ceramic substrate and decomposition of the solution did not occur.

Aminobenzenesulfonic acid was added to the Base Solution 4 in place of the p-toluenesulfonamide, and thus an electroless gold plating solution was prepared. When this solution was used, the same good results as described above were obtained.

EXAMPLE 19

An electroless gold plating solution was prepared by adding 10.0 g/l of a propiolic acid and 10.0 g/l of aminobenzenesulfonic acid to the Base Solution 5. Using this solution, an electroless gold plating was carried out on an immersion gold-plated nickel substrate of a ceramic package for a semiconductor device for 1 hour under conditions of a mild agitation and temperature of 85° C. This plating was carried out 10 times. A deposition of gold on a ceramic substrate and decomposition of the solution did not occur.

To the above-mentioned solution was added 0.001 ml/l of polyoxyethylene phenyl ether as a surfactant. Using the obtained electroless gold plating solution, an electroless gold plating was carried out. The dissipation of bubbles generated in this plating became good, and thus a uniform electroless gold plating coating was obtained.

When 1,5-naphthalenedisulfonic acid, 1,3,6-naphthalenetrisulfonic acid or alkali metal salts thereof were added to the solution in place of the aminobenzenesulfonic acid, substantially the same good results as described above were obtained.

EXAMPLE 20

An electroless gold plating solution was prepared by adding 5.0 g/l of propargyl alcohol, 15.0 g/l of glycine and 12.0 g/l of potassium chloride to the solution 4. The pH of the obtained plating solution was 11.4.

After an alumina ceramic package was dipped in 400 ml of the electroless gold solution having the pH of 11.4, the Si concentration in the solution was analyzed, and it proved that the Si concentration was the same as before the dipping. The ceramic substrate under the nickel under layer was not corroded.

Further, using this solution, an electroless gold plating was carried out on an electroless nickel plated ceramic package and immersion gold plated ceramic package, and a gold deposition rate of 1.7 μm/hour was obtained. The obtained value of 1.7 μm/hour was substantially the same as that obtained before the addition of glycine and potassium chloride. During this plating, decomposition of the solution did not occur.

When 5.0 g/l of propargyl alcohol and 20.0 g/l of glycine were added to the solution 4, the pH of the solution became 11.0, and when a ceramic package was immersed in the solution, no dissolution of Si from the ceramic package occurred.

Further, the gold deposition rate during the electroless gold plating was 1.7 μm/hour.

When 5.0 g/l of propargyl alcohol and a 30.0 g/l of potassium chloride were added to the solution 4, the pH of the obtained solution became 11.8, and when a ceramic package was immersed in this solution, a dissolution of Si from the ceramic package did not occur.

Further, the gold deposition rate during the electroless gold plating was 1.6 μm/hour.

By adding at least one of the chemicals of the group of glycine and potassium chloride to the electroless gold plating solutions, the pH of the solution was lowered to within 10 to 12. In this case, decomposition of the solution did not occur, the gold plating deposition rate was high and corrosion of the ceramic was prevented.

Furthermore, in the above-mentioned examples 11 to 20, lead compounds or thallium compound was added to the base solutions 4 or 5, with the result that the properties of the electroless gold plating coating were further improved.

We claim:

1. An electroless gold plating solution comprising:
   a base solution containing an alkaline hydroxide, a water-soluble gold salt, a boron hydride or an amino borane, and an alkali metal cyanide; and
   at least one compound selected from the group consisting of fatty unsaturated alcohols, fatty unsaturated polyhydric alcohols, fatty unsaturated carboxylic acids and derivatives thereof.

2. An electroless gold plating solution according to claim 1, wherein said compound is allyl alcohol, crotyl alcohol, propargyl alcohol, 2-butyne-1-ol, 3-butyne-1-ol or an ester thereof.

3. An electroless gold plating solution according to claim 1, wherein said compound is 2-butyne-1,4-diol, 1-butyne-3,4-diol, 2-pentyne-1,5-diol, 2-pentyne-1,4-diol or an ester thereof.

4. An electroless gold plating solution according to claim 1, wherein said compound is propiolic acid, acetylenedicarboxylic acid, ethyl propiolate, or ethyl acetylenedicarboxylate.

5. An electroless gold plating solution according to claim 1, further containing at least one member selected from the group consisting of sulfonic acid derivatives or salts thereof, sulfonamide derivatives or sulfonimide derivatives or salts thereof.

6. An electroless gold plating solution according to claim 1, wherein said member is aminobenzenesulfonic acid, 1,5-naphthalenedisulfonic acid, 1,3,6-naphtalenetrisulfonic acid or an alkali metal salt thereof.

7. An electroless gold plating solution according to claim 5, wherein said member is aminosulfonamide or toluenesulfonamide.

8. An electroless gold plating solution according to claim 5, wherein said member is o-sulfonbenzimide or an alkali metal salt thereof.

9. An electroless gold plating solution according to claim 1, further containing an amount of a monoamino monocarboxylic acid, an alkali chloride or a mixture thereof sufficient to cause the solution to exhibit a pH of 10 to 12.

10. An electroless gold plating solution according to claim 9, wherein said monoamino monocarboxylic acid is glycine, alanine or valine.

11. An electroless gold plating solution according to claim 1, wherein said base solution further contains at least one surfactant.

12. An electroless gold plating solution according to claim 11, wherein said at least one surfactant is polyoxyethylenealkylphenylether or polyoxyethylenealkylether.

13. An electroless gold plating solution according to claim 1, wherein said base solution further contains a thallium compound or a lead compound.

14. An electroless gold plating solution according to claim 1, wherein said base solution further contains a sulfur compound containing a mercapto group.

15. An electroless gold plating solution according to claim 14, wherein said sulfur compound is thiourea or thiomalic acid.

16. An electroless gold plating solution according to claim 5, further containing an amount of a monoamino monocarboxylic acid, an alkali chloride or a mixture thereof sufficient to cause the solution to exhibit a pH of 10 to 12.

17. An electroless gold plating solution according to claim 16, wherein said monoamino monocarboxylic acid is glycine, alanine or valine.

18. An electroless gold plating solution according to claim 5, wherein said base solution further contains at least one surfactant.

19. An electroless gold plating solution according to claim 18, wherein said at least one surfactant is polyoxyethylenealkylphenylether or polyoxyethylenealkylether.

20. An electroless gold plating solution according to claim 5, wherein said base solution further contains a thallium compound or a lead compound.

21. An electroless gold plating solution according to claim 5, wherein said base solution further contains a sulfur compound containing a mercapto group.

22. An electroless gold plating solution according to claim 21, wherein said sulfur compound is thiourea or thiomalic acid.

* * * * *